US007867565B2

(12) United States Patent
Fyen et al.

(10) Patent No.: US 7,867,565 B2
(45) Date of Patent: Jan. 11, 2011

(54) METHOD FOR COATING SUBSTRATES

(75) Inventors: Wim Fyen, Leuven (BE); Paul W. Mertens, Bonheiden (BE)

(73) Assignee: IMEC, Leuven (BE)

( * ) Notice: Subject to any disclaimer, the term of this patent is extended or adjusted under 35 U.S.C. 154(b) by 1043 days.

(21) Appl. No.: 10/883,420

(22) Filed: Jun. 30, 2004

(65) Prior Publication Data

US 2005/0079291 A1 Apr. 14, 2005

Related U.S. Application Data

(60) Provisional application No. 60/484,081, filed on Jun. 30, 2003.

(51) Int. Cl.
*B05D 5/12* (2006.01)

(52) U.S. Cl. ..... 427/348

(58) Field of Classification Search ..... 427/240, 427/348

See application file for complete search history.

(56) References Cited

U.S. PATENT DOCUMENTS

| | | | | |
|---|---|---|---|---|
| 4,027,686 | A | | 6/1977 | Shortes et al. |
| 4,128,667 | A | * | 12/1978 | Timson ..... 427/348 |
| 4,608,268 | A | * | 8/1986 | Shimkunas ..... 427/8 |
| 4,838,289 | A | | 6/1989 | Kottman et al. |
| 4,871,417 | A | | 10/1989 | Nishizawa et al. |
| 5,058,610 | A | | 10/1991 | Kuriyama |
| 5,248,380 | A | | 9/1993 | Tanaka |
| 5,271,774 | A | | 12/1993 | Leenaars et al. |
| 5,375,291 | A | | 12/1994 | Tateyama et al. |
| 5,660,642 | A | | 8/1997 | Britten |
| 5,705,223 | A | | 1/1998 | Bunkofske |
| 5,749,413 | A | | 5/1998 | Crowe |
| 5,873,380 | A | | 2/1999 | Kanno |
| 5,887,605 | A | | 3/1999 | Lee et al. |
| 5,922,407 | A | * | 7/1999 | Hess et al. ..... 427/348 |
| 5,945,351 | A | | 8/1999 | Mathuni |
| 5,964,952 | A | | 10/1999 | Kunze-Concewitz |
| 5,972,127 | A | | 10/1999 | Thompson et al. |

(Continued)

FOREIGN PATENT DOCUMENTS

| | | |
|---|---|---|
| JP | 59-184530 | 10/1984 |

(Continued)

OTHER PUBLICATIONS

S. Wolf and R. Tauber, Silicon Processing for the VLSI Era, Lattice Press, Chapters 6 and 11, pp. 149-224 and pp. 434-487, 2000.

(Continued)

*Primary Examiner*—Brian K Talbot
(74) *Attorney, Agent, or Firm*—McDonnell Boehnen; Hulbert & Berghoff LLP

(57) ABSTRACT

A method for depositing a coating layer on at least a part of a surface of a substrate is described. The method includes supplying a coating substance to at least part of a surface of a substrate. The substrate is subjected to a relative movement with respect to a source of the coating substance. The surface tension of the coating substance is modified, at least locally, at least part of the time while the at least part of the substrate is subjected to the movement. A thickness of the coating layer is influenced by modifying the surface tension of the coating substance.

13 Claims, 5 Drawing Sheets

U.S. PATENT DOCUMENTS

| | | | | |
|---|---|---|---|---|
| 5,980,647 | A | 11/1999 | Buker et al. | |
| 5,997,653 | A | 12/1999 | Yamasaka | |
| 6,059,893 | A | 5/2000 | Kawasaki | |
| 6,106,635 | A | 8/2000 | Hamada et al. | |
| 6,177,128 | B1 * | 1/2001 | Goppert-Berarducci et al. | 427/8 |
| 6,334,902 | B1 | 1/2002 | Mertens et al. | |
| 6,398,975 | B1 | 6/2002 | Mertens et al. | |
| 6,491,764 | B2 | 12/2002 | Mertens et al. | |
| 6,568,408 | B2 | 5/2003 | Mertens et al. | |
| 6,703,067 | B2 * | 3/2004 | Moon et al. | 427/8 |
| 6,740,194 | B2 * | 5/2004 | Rushford et al. | 156/345.15 |
| 6,821,349 | B2 | 11/2004 | Mertens et al. | |
| 6,851,435 | B2 | 2/2005 | Mertens et al. | |
| 6,884,462 | B2 * | 4/2005 | Whitman | 427/240 |
| 6,887,584 | B2 * | 5/2005 | Williams et al. | 428/532 |
| 6,946,407 | B2 * | 9/2005 | Davlin et al. | 438/782 |
| 7,208,201 | B2 * | 4/2007 | Kanke | 427/299 |
| 2003/0098531 | A1 * | 5/2003 | Horie et al. | 266/127 |

FOREIGN PATENT DOCUMENTS

| | | |
|---|---|---|
| JP | 61-2948825 | 12/1986 |
| JP | 62-232923 | 10/1987 |
| JP | 63-47929 | 2/1988 |
| JP | 02280330 | 11/1990 |
| JP | 02309638 | 12/1990 |
| JP | 07211686 | 8/1995 |
| JP | 09162159 | 6/1997 |
| JP | 11350169 | 12/1999 |

OTHER PUBLICATIONS

E.D. Cohen and E. B. Gutoff, Modem Coating and Drying Technology, Wiley VCH, Introduction and Chapter 1, pp. xv-xx and pp. 1-21, 1992.

P.W. Atkins, Physical Chemistry, Fourth Edition, Oxford University Press, Section 6.8, p. 150, 1990.

A.W. Adamson, Physical Chemistry of Surfaces, Fifth Edition, John Wiley & Sons, Inc., Chapter III, pp. 53-61, 1990.

T. Molenkamp, "Marangoni Convection, Mass Transfer and Microgravity", Ph. D. Thesis, Rijksuniversiteit Groningen, The Netherlands, Nov. 1998.

X. Fanton et al., "Thickness and Shape of Films Driven by a Marangoni Flow", Langmuir, vol. 12, pp. 5875-5880, 1996.

O.O. Ramdane and D. Quéré, "Thickening Factor in Marangoni Coating", Langmuir, vol. 13, pp. 2911-2916, 1997.

European Search Reports for EP 00 87 0135 dated Nov. 15, 2000.

European Search Report for EP 98870200 dated Jan. 6, 1999.

* cited by examiner

METHOD FOR COATING SUBSTRATES

PRIORITY

The present patent application claims priority under 35 U.S.C. §119(e) to U.S. Provisional Patent Application Ser. No. 60/484,081; filed on Jun. 30, 2003, titled "Method for Coating Substrates." The full disclosure of U.S. Provisional Patent Application Ser. No. 60/484,081 is incorporated herein by reference.

RELATED APPLICATIONS

This application is related to the following filed U.S. Applications, which are incorporated by reference herein:

U.S. patent application Ser. No. 10/074,706; filed on Feb. 13, 2002, titled "Method and Apparatus for Localized Liquid Treatment of the Surface of a Substrate," and U.S. patent application Ser. No. 09/998,889; filed on Nov. 1, 2001, titled "Method and Apparatus for Removing a Liquid from a Surface."

FIELD

The present invention relates generally to forming a thin film, which is also called a coating, on a substrate.

BACKGROUND

Coatings may be prepared in the gas phase (using chemical vapor deposition or physical vapor deposition—See, e.g., *Silicon Processing for the VLSI Era*, S. Wolf and R. Tauber, Lattice Press Calif., USA, 2000—Chapters 6 and 11) or in the liquid phase. When a coating is prepared in the liquid phase, the coating liquid used in the process may contain a variety of components, such as binders, solvents, and additives. (See, e.g., *Modern Coating and Drying Technology*, E. Cohen and E. Gutoff, Wiley VCH, 1992, pp 1, which is hereby incorporated by reference in its entirety.) The coating liquid may also be identical in composition as the final coated film, such as in case of molten materials.

Various methods exist for applying the coating liquid to the substrate, including dip coating, rod coating, knife coating, blade coating, air knife coating, gravure coating, roll coating, slot coating, slide coating, curtain coating, Langmuir Blodgett coating, spray coating, spin coating, and the like. (See, e.g., *Modern Coating and Drying Technology*, E. Cohen and E. Gutoff, Wiley VCH, 1992, pp 6-10.) In many of these methods (but not all), the substrate is brought into contact with the coating liquid and a relative motion between the substrate and the coating liquid is induced.

These liquid coating processes rely on a balance between: a viscous force; a body force, such as centrifugal force, gravity, and/or friction (depending on the particular configuration); pressure of (gaseous) ambient air, gas and/or vapor; and surface tension. The magnitude of these forces influences a thickness of the liquid film left behind (see FIG. 1).

An example of a liquid coating process includes pulling substrates (such as plates, foil, or wire) through a bath of molten coating material (where the substrate, wire, or foil material has typically a higher melting point than the coating substance). Other examples include wire coating with polymers, metal coating with Zn film from molten Zn baths, dip coating, and the like.

Various methods exist to control the coating film thickness. Some of the methods that are used to control the coating film thickness include the use of "air knives," metering blades, knives, metering rolls, and gravure rolls. (See, e.g., *Modern Coating and Drying Technology*, E. Cohen and E. Gutoff, Wiley VCH, 1992, pp 2-3.) Examples include the following. Air knives consist of slit-shaped nozzles through which pressurized gas (or air) is blown at high speed. The impact of the gas stream on the liquid surface reduces the thickness of the film left behind, through the impact force. An inherent side effect of these air knives is that they typically involve strong flows of gases which may lead to additional contamination from the air flow and strong evaporation effects, leading to additional contamination (due to enhanced solvent evaporation). Metering blades (also known as "doctor blades") or knives reduce the film thickness through scraping away excess liquid from the substrate. Metering rolls and gravure rolls determine the amount of coating liquid that is delivered to the moving substrate.

Ramdane and Quéré report in "Thickening factor in Marangoni coating" (Langmuir 1997) on solutions containing surfactants that create a Marangoni flow, which thicken the film when pulling a solid out of solution. However, this method is not applicable for reducing the film thickness to be comparable to a film thickness resulting from pulling a solid out of pure liquid.

Fanton et al. teach in "Thickness and shape of films driven by Marangoni flow" (Langmuir 1996) that the film thickness is dependent on a surface tension gradient, which can be induced by a temperature gradient. However, this method is not applicable for all kinds of substrates.

SUMMARY

A method for depositing a coating layer on at least part of a surface of a substrate is disclosed. The method includes supplying a coating substance to the at least a part of the surface of the substrate, subjecting the substrate to a relative movement with respect to a source of the coating substance, and modifying the surface tension of the coating substance. The modifying of the surface tension of the coating substance is performed locally and at least a part of the time while subjecting the substrate to the movement, which influences the thickness of the coating layer.

The coating layer may be a continuous layer or a non-continuous layer. Supplying a coating substance to at least a part of the surface includes contacting the at least part of the surface of the substrate with at least part of the coating substance. Subsequently, the contacted surface is then subjected to a surface tension modification process. In particular, a three-phase region (see definition below) is subjected to the surface tension modification process.

Influencing the thickness of the coating layer includes increasing or decreasing the thickness within a range of predetermined values. Influencing the thickness of the coating layer also includes adjusting the thickness to a predetermined value or a range of predetermined values. Preferably, adjusting the thickness is understood as increasing or decreasing the thickness of the deposited coating layer.

Modifying the surface tension creates a surface tension gradient in the deposited coating substance. In particular, modifying the surface tension includes increasing or decreasing the surface tension of the deposited coating substance, in such a way that there are at least two points in the coating substance exhibiting a different surface tension.

Modifying the surface tension may be performed using an external device. The modification the surface tension influences the surface tension of the deposited coated substance. The external device is a device that is not part of the coating substance. Additionally, the external device may be a device delivering a physical quantity affecting the surface tension of the deposited coating substance. More particularly, the external device may be a device delivering a surface tension affecting substance. Additionally or alternatively, the external device may be a device delivering heat or any other means to locally affect the temperature distribution of the coating substance.

The surface tension affecting substance may be in the form of a liquid, a solid, a vapor, a mist, or a gas. In one example, the external device locally delivers a surface tension lowering gas, such as isopropyl alcohol (when delivered to aqueous liquids), which decreases the thickness of the deposited coating layer. Alternatively, a surface tension increasing substance may be used to increase the coating layer thickness.

A device delivering heat or any other means to locally affect the temperature distribution of the coating substance may locally adjust the temperature, depending on the desired thickness of the deposited coating layer. In particular, the temperature controlling device heats the deposited coating liquid (creating a local lowering of the surface tension), which decreases the thickness of the coating liquid. Heating may be performed by means of incident electro-magnetic radiation, infra-red light, radiation, or other appropriate method.

In one example, the method of depositing a coating layer on at least a part of a surface of a substrate includes chemically or physically modifying the deposited coating layer to form a coating layer. Modifying the deposited coating layer may be performed by thermal treating (thereby obtaining evaporation of solvent), subjecting to a predetermined ambient (e.g., oxidizing ambient, and the like), crystallisation, and/or recrystallization.

The deposited coating layer may have a thickness below 10 micrometer, below 5 micrometer, below 1 micrometer, below 500 nm, below 100 nm, or below 10 nm. Preferably, the deposited coating layer has a thickness below 100 nm. The deposited coating layer can be a continuous layer or a non-continuous layer.

The coating substance may be molten material (such as a metal), sol gel solution, or any film precursor brought into the liquid state by means of melting, dissolution, or any other physical or chemical modification which may require the use of additional products or species (such as chelating agents, complexing agents, counterions, and the like).

The movement is a relative movement between the substrate and a source of the coating substance, delivering the coating substance. The movement may be a rotational or a linear movement, or a combination of both rotational and linear movements.

The coating layer made by the method for depositing a coating layer on at least part of a surface of a substrate may be used in integrated circuit fabrication processes.

These as well as other aspects and advantages will become apparent to those of ordinary skill in the art by reading the following detailed description, with reference where appropriate to the accompanying drawings. Further, it is understood that this summary is merely an example and is not intended to limit the scope of the invention as claimed.

BRIEF DESCRIPTION OF THE DRAWINGS

Presently preferred embodiments are described below in conjunction with the appended drawing figures, wherein like reference numerals refer to like elements in the various figures, and wherein.

DETAILED DESCRIPTION

As used throughout this specification, the term "coating" may be defined as "the replacement of air with a new material on a surface of a substrate." (See, e.g., *Modern Coating and Drying Technology*, E. Cohen and E. Gutoff, Wiley VCH, 1992, Foreword.) The arrangement of the new material on the surface of the substrate can be in the form of a uniform film or can be in the form of a regular or irregular pattern. The term "substrate" can refer to a solid piece of material of various geometries (e.g., plate, wire, ribbon, tape, tube, sheet).

The purpose of applying such a coating layer can vary, depending on the particular application, but generally two basic types can be distinguished. (See, e.g., *Modern Coating and Drying Technology*, E. Cohen and E. Gutoff, Wiley VCH, 1992, pp 4-5.) A first category contains coatings that are sold as final product, such as paints, photographic films, X-ray films, plates for printing, containers for food packaging, magnetic storage media, optical disks, adhesive tape, wallpaper, and so on. In a second category, the coating forms an integral part of a particular application or forms an intermediate product in the production process, such as photoresists, coatings for interconnecting components on circuit boards, adhesive coatings during a fabrication process, various layers deposited during the fabrication of a micro-electronic circuit or sensor, and so on.

The following description refers to a coating liquid. It is understood however that the description can be applied to other coating substances such as a vapor, a molten metal, a sol-gel solution, a mist, a gas, a finely dispersed solid, and combinations thereof.

Figure 1:
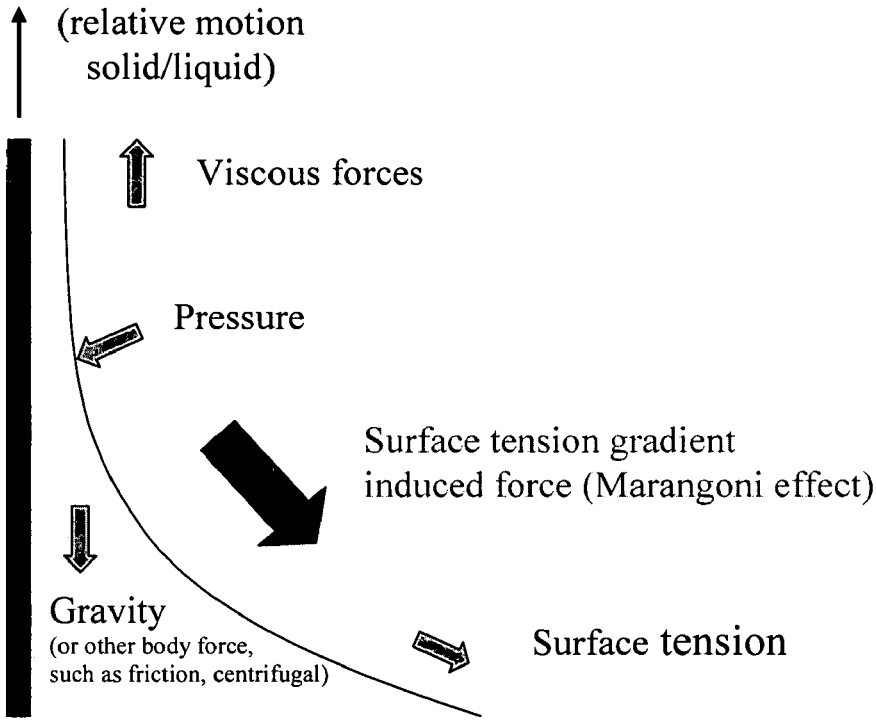
FIG. 1 is a diagram of a typical case of coating a substrate surface with a liquid.

A surface tension modifying process is used to influence the thickness of the coating layer that is deposited. The surface tension modifying process creates a surface tension gradient in the deposited coating layer (also called coating film). The application of the use of surface tension gradients to influence the coating film thickness is also illustrated on FIG. 1 (for the particular case where the surface tension gradient results in a reduction in coating film thickness).

The surface tension of a substance such as, but not limited hereto, a liquid depends on many physical properties from which temperature and concentration of a tension-active component are particularly suited to generate a difference in local surface tension. (See, e.g., T. Molenkamp, PhD thesis, 1998, "Marangoni Convection, Mass Transfer and Microgravity", Rijksuniversiteit Groningen, The Netherlands.) The surface tension gradient is preferably generated in a three-phase contact area.

The three-phase contact area may be defined as the region where the substrate, coating substance, and gas phase (this can be the ambient gas phase, e.g. air) meet each other and which is characterized by an increase in liquid film thickness (measured perpendicularly to the substrate) when moving towards the region from where the coating liquid is being delivered (e.g. the recipient). The surface tension gradient is generated such that the direction of the surface tension gradient assists in reducing or increasing the thickness of the coating layer.

The three phase contact region is defined by the particular properties of the embodiments that are used in the coating process, as well as by the properties of the coating liquid, ambient gas phase, and surface properties of the substrate, which can be adequately tailored by a person skilled in the art. Preferably, the surface tension gradient is generated by means of a source that is externally positioned with respect to the substrate and the coating liquid (e.g., delivery of a soluble tensio-active component, external heat source, and the like).

In the embodiment of the temperature induced surface tension gradients, it is well known that the surface tension of a liquid generally decreases with temperature (P. W. Atkins, Physical Chemistry, and A. W. Adamson "Physical Chemistry of Surfaces", fifth edition, 1990, John Wiley & Sons, inc., New York). This means that if the external heat source (or heat sink) results in a temperature gradient, having the highest temperature in the part of the three phase region nearest the substrate, a flow in the coating liquid is created, resulting in a reduced film thickness of the coated layer (as compared to a comparable embodiment that does not comprise the external source). Alternatively, a temperature gradient in the opposite direction, i.e. having the lowest temperature in the part of the three phase region nearest the substrate, may result in an increased thickness of the coated film (as compared to a comparable embodiment that does not comprise the external source).

In a similar manner, the external source may also deliver through the gas phase a component having a surface tension differing from the surface tension of the coating liquid (and at least partly soluble in it), which upon contact with the liquid at the three phase region, induces a surface tension gradient at the surface of the liquid (e.g., by having tensio-active properties in combination with a non-zero solubility in the coating liquid).

For an external species with a surface tension lower than the coating liquid, the resulting surface tension gradient is a result of the gradient in local concentrations of the external species, which in turn is the result of the difference in local thickness of the coating liquid in the three phase region. Under these conditions, the coating film thickness may be reduced with respect to a similar embodiment not comprising a system suitable for delivering an external tensio-active component. Alternatively, obtaining a thicker film may be achieved by delivering an external component whose surface tension is higher than the coating liquid.

After deposition of the coating film, an additional step may be required for the purpose of improving the film properties, such as a thermal curing step, a heat treatment step to drive out (at least part of) the additives present in the coating film, a recrystallization step to transform the film into the appropriate crystallographic phase, and the like.

The method for coating substrates allows obtaining a significant reduction in film thickness compared to a state-of-the-art method. Additionally, when the coating liquid comprises a solvent that is removed during the post-treatment step, the method results in less contamination from undesired trace impurities present in the substrate material. Moreover, a lower purity of the solvent is required, which provides a more cost effective solution. As a result, for a given thickness, a more concentrated coating liquid can be used, requiring less evaporation of solvent in the post-treatment step, which reduces the amount of contamination originating from the evaporation process.

Furthermore, the method results in less risk of cracking or other structural defect formation related to the transformation to a solid by evaporation of a solvent, since for the same thickness of final film, less total amount of liquid (and thus less solvent) can be used. As an illustration of this, note the crack formation in the dip-coated sample (See, FIG. 4), which is absent in the sample coated according to the method described with reference to FIG. 2 (See, FIG. 5).

Figure 2:
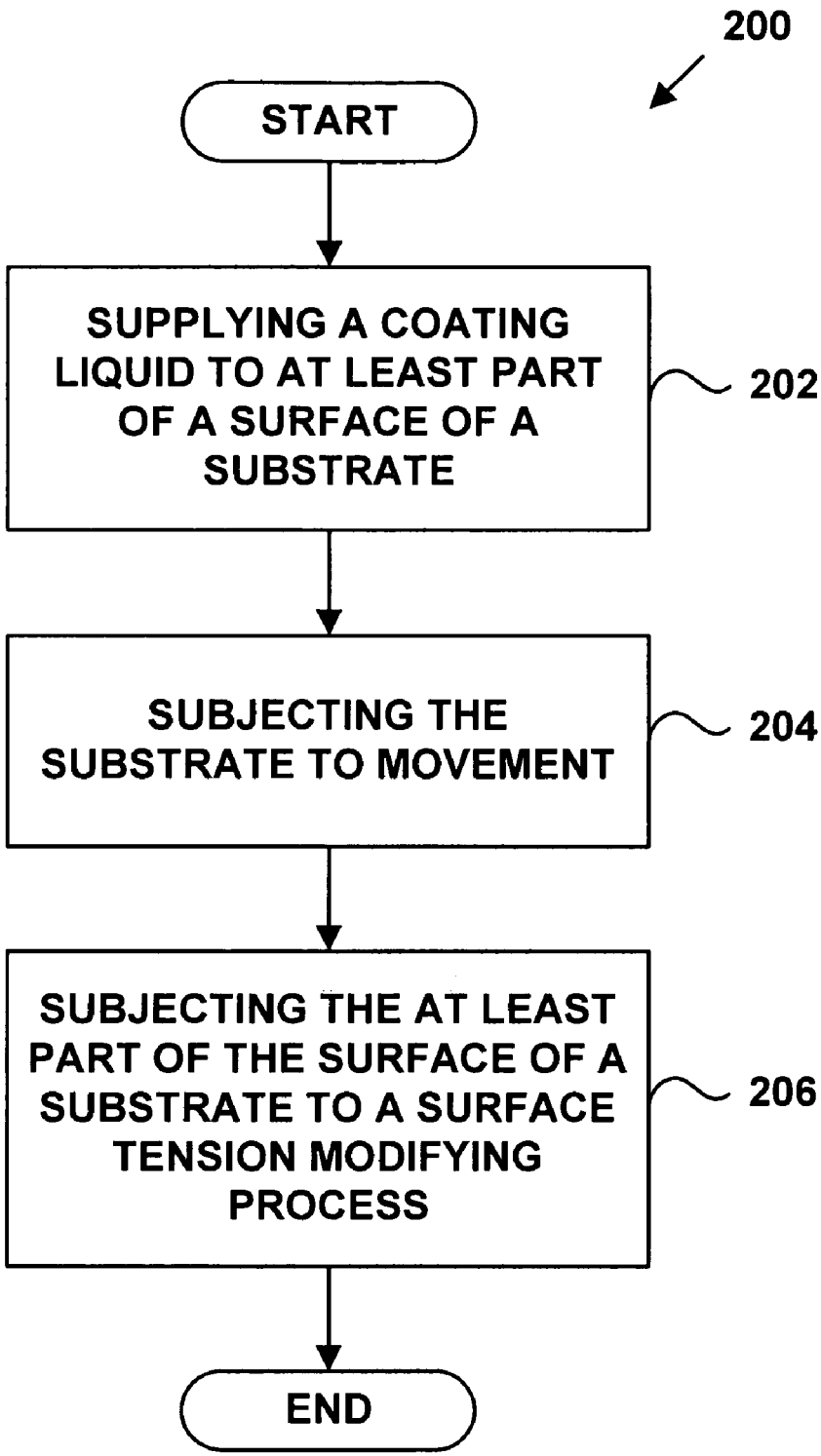
FIG. 2 is a block diagram of a method for coating a substrate according to an example.

FIG. 2 is a block diagram of a method 200 for coating a substrate. At block 202, a coating liquid is supplied to at least a part of the surface of the substrate. The substrate comprises preferably a solid material and the coating liquid comprises the species to be deposited. The species to be deposited may be transformed into the liquid state prior to deposition. The substrate and coating liquid may be chosen so that under ambient conditions good wetting properties of the coating liquid are obtained on the substrate. Good wetting properties may be characterized by a contact angle between a liquid and a substrate that is less than 90 degrees, and preferably less than 45 degrees. Preferably, the contact angle between the coating liquid and the substrate is less than 35 degrees.

At block 204, the substrate is subjected to movement. The movement may be understood as a relative movement of the surface of the substrate with respect to the source of the liquid. A list of non-limiting examples is provided as follows.

In one example, a vessel contains the coating liquid. The substrate is immersed in the vessel and withdrawn through the free surface that is formed under the influence of a body force, such as gravity, at a speed between 0.1 mm/s and 10 m/s, and preferably in the range between 0.1 mm/s and 10 mm/s.

Another example includes a recipient containing the coating liquid through which a substrate having at least one dimension significantly larger than the dimensions of the recipient is pulled (such as a wire, tape, and the like) at a speed between 0.1 mm/s and 10 ms/, and preferably in the range between 0.1 mm/s and 10 mm/s.

Another example includes a delivery system that is capable of delivering the coating fluid onto the surface of the substrate under conditions in which a continuous and distinct perimeter is formed at the interface of the contact between the coating fluid, the substrate surface, and the ambient gas phase. This perimeter forms the onset of the three phase contact region. By inducing a relative motion between the surface of the substrate and the delivery system, the perimeter moves over the surface of the substrate that is to be coated.

The delivery system may include nozzles delivering an uninterrupted flow of the coating liquid onto the surface of the substrate. A perimeter may be formed at the contact area, where the flow of the coating liquid being delivered onto the surface of the substrate intersects with the surface of the substrate. Depending on the geometrical configuration of such a nozzle system, the shape of the perimeter may be circular, prolonged (e.g., for slit shaped nozzles), or any other shape.

In another example, the delivery of the liquid may occur by means of a device in close contact with the surface of the substrate that provides additional functionality to the process. An example of such a device is a brush or a sponge. The brush or sponge has a relative motion with respect to the surface of the substrate and is capable of delivering the coating liquid to the surface of the substrate. The brush or sponge delivers the coating liquid at substantially the same time a mechanical interaction is taking place between the surface of the substrate and the material comprising the brush or sponge. In this manner, the brush or sponge may precondition or pre-clean the surface of the substrate prior to the coating process.

At block 206, at least part of the surface of the substrate is subjected to a surface tension modifying process. This process results in a surface tension gradient being generated in the three phase contact region. The surface tension gradient may be generated by using a difference in temperature, a concentration of surface active species, or another means capable of inducing a surface tension gradient.

The physical property responsible for the difference in surface tension is induced by the delivery of an appropriate physical quantity. For example, for a thermally induced Marangoni effect, the physical quantity comprises heat or any other means to affect the temperature distribution. As another example, for a concentration induced Marangoni effect, the physical quantity comprises a concentration of a surface active compound.

The physical quantity is delivered by an appropriate device that is not initially part of the substrate or part of the coating liquid. An example of an appropriate device for the temperature induced Marangoni effect is a device that delivers a flow of heat, such as electromagnetic radiation of a wavelength that is suitable to be adsorbed by the liquid or the substrate. Another example of an appropriate device for the temperature induced Marangoni effect is a device that delivers a flow of fluid at a temperature different from the temperature of the coating liquid in the three-phase region. The flow of fluid may change the temperature distribution of the coating liquid in the three phase contact region by means of physical contact between the coating liquid and the fluid at a different temperature.

An example of an appropriate device for the concentration induced Marangoni effect is a device that delivers a flow of a soluble component having a non-zero solubility in the coating liquid and resulting in a variation of the surface tension upon dissolving in the coating liquid. Especially strong Marangoni effects may be obtained when the coating liquid has a high surface tension, preferably above 50 mN/m and more preferably close to 72 mN/m. The coating liquid may have a high surface tension when water is the primary constituent of the coating liquid; other components in the coating liquid, such as additives, do not have a drastic effect on the surface tension of the liquid; and the surface tension reducing component is an organic molecule with a surface tension lower than 50 nM/m, preferably between 10 and 30 mN/m. The surface tension reducing component may be an alcohol, a carboxylic acid, an alkane, an alkene, or a ketone having a non-zero solubility in water.

The surface tension reducing component may be delivered to the three phase contact region by using an inert carrier fluid. Preferably, the inert carrier fluid consists of air or nitrogen gas into which the tensio-active component is entrained. The surface tension reducing component may be chosen so that the surface tension reducing component has a preference to be in the liquid phase, has a vapor pressure high enough at the operating temperatures, and a solubility in the carrier gas such that the surface tension reducing component can be entrained with the carrier gas by bringing the two components into physical contact. The two components may be brought into physical contact by means of a device known to a person skilled in the art, such as a bubbler system. Such a bubbler system acts as to separate the flow of the inert carrier fluid into smaller flows (typically thermodynamically encountered as bubbles), which enhances the area of contact between the phases of the surface tension reducing component and the inert carrier fluid, resulting in an increased mass transfer.

The surface tension reduction is induced in the three phase region in the following way. For thinner films the surface tension reduction is induced in such a way that the largest surface tension exists in the liquid source. For thicker films the surface tension reduction is induced in such a way that the largest surface tension exists on the substrate side (i.e., not on the liquid side).

Subsequent process steps may be performed after the surface tension modifying process of the at least part of the surface of the substrate. For some applications, the deposited coating layer can fulfill requirements with no further treatment. However, if a solid film is desired, the deposited liquid coating layer may be transformed into the solid state by a post-treatment process step, such as baking, solidification, and evaporation of volatile carrier material. Additionally, subsequent process steps may be performed when an objective of the coating is to obtain a thin film that has a particular functionality within a given structure from which the coating process forms a dedicated part of the fabrication process.

Example 1

A first example of the application of this invention relates to the reduction of the coating thickness of a molten metal, such as Zn, which is used as anodic corrosion protection material in steel wires and other products composed of metal. This is a common case in industrial applications where the purpose is to reduce consumption of fairly expensive Zn in corrosion protection coating.

The wire is pulled through a bath of molten Zn. The wire is heated at the point where the wire is withdrawn from the melt. At this point where the substrate, liquid source, and the air coincide is the three-phase region. Heating may be performed in various ways, such as using additional radiative heat sources, inductive heating, or by applying a voltage to the system such that a current flows through the three-phase region. A surface tension gradient is created over the molten Zn surface that results in a flow of liquid Zn along the surface from the three-phase region with low surface tension (i.e. from the wire) towards the higher surface tension (i.e. towards the melt in the bath). Thus a thinner Zn film is obtained. Additionally, the Zn will remain as a liquid for a longer time, allowing more time for the Zn to "drip down" resulting in a lower thickness.

Example 2

In a second example the purpose is to increase the thickness of the coating of Zn onto steel wire. The wire is pulled through a bath of molten Zn. At the point where the wire is withdrawn from the melt, the wire is cooled. This cooling may be done in various ways. For example, the wire may be cooled by using cooling gas or liquid flows, or by contacting cooled solid surfaces (e.g. wheels). A surface tension gradient is created over the molten Zn surface that results in a flow of liquid Zn along the surface from the region with low surface tension (i.e. from the melt in the bath) towards the higher surface tension (i.e. towards the wire). In this way a thicker coating is obtained. Additionally, the Zn will remain as a liquid for a shorter time leaving less time for the Zn to "drip down" resulting in an enhanced thickness.

Example 3

In a third example, the application is to deposit a thin layer of a ferro-electric material onto a flat substrate from an aqueous solution in which the ferro-electric material is present in the form of an appropriate precursor, in a volume concentration $C_0$, which is preferably in the range between $10^{-6}$M to 10M, and more appropriately in the range 0.1-5M. Preferably, the concentration is between 0.1 and 1M.

In tests, the precursor solution has been prepared for a $(BiLa)_4Ti_3O_{12}$ or "BLT" layer in a concentration of 0.7M. The flat substrate consisted of a piece of polished bare Si material which was thoroughly cleaned and covered with a protective oxide layer (e.g., obtained by rinsing in ozonated ultrapure water).

The substrate is vertically withdrawn from the solution at a speed on the order of 5 mm/s. The surface tension gradient is induced by blowing an appropriate volatile, soluble tension-active component (such as IsoPropyl Alcohol—IPA) onto the three-phase region through a slit-shaped nozzle in a flow on the order of 0.5 SLM per cm width in a concentration on the order of approximately 4 volume %. The latter is obtained by bubbling an inert carrier gas (in this case nitrogen), through liquid IPA at room temperature.

By means of comparison, the same precursor film is coated onto the same substrate by means of spin-coating at 3000 rotations per minute. This can be considered as being representative of a state-of-the-art process, as it would be preferred by a person skilled in the art. Additionally, the same precursor solution is also coated onto the same substrate by means of dip-coating. In the latter, the substrate is withdrawn vertically from a recipient containing the precursor solution at the same withdrawal speed as the tests described above.

After the coating process, the coated film is cured by a heat treatment consisting of 1 minute at 160 degrees Celsius, 4 minutes at 260 degrees Celsius, and 2 minutes at 650 degrees Celsius. After these heat treatment steps, the films are analysed by spectroscopic ellipsometry (SE) at an angle of 75.09 degrees with respect to the surface normal and a wavelength range between 300-850 nm and by Rutherford Backscattering (RBS).

From the spectroscopic ellipsometry data, the real and imaginary part of the refractive index of the film was determined. A Sellmeier (2) model assuming 1 homogenous film on the silicon substrate was fitted to these results in order to extract a value for the film thickness. From the RBS results, a thickness was extracted by fitting the energy spectrum to a simulated spectrum containing Bi, Ti, La, and O.

Figure 3:
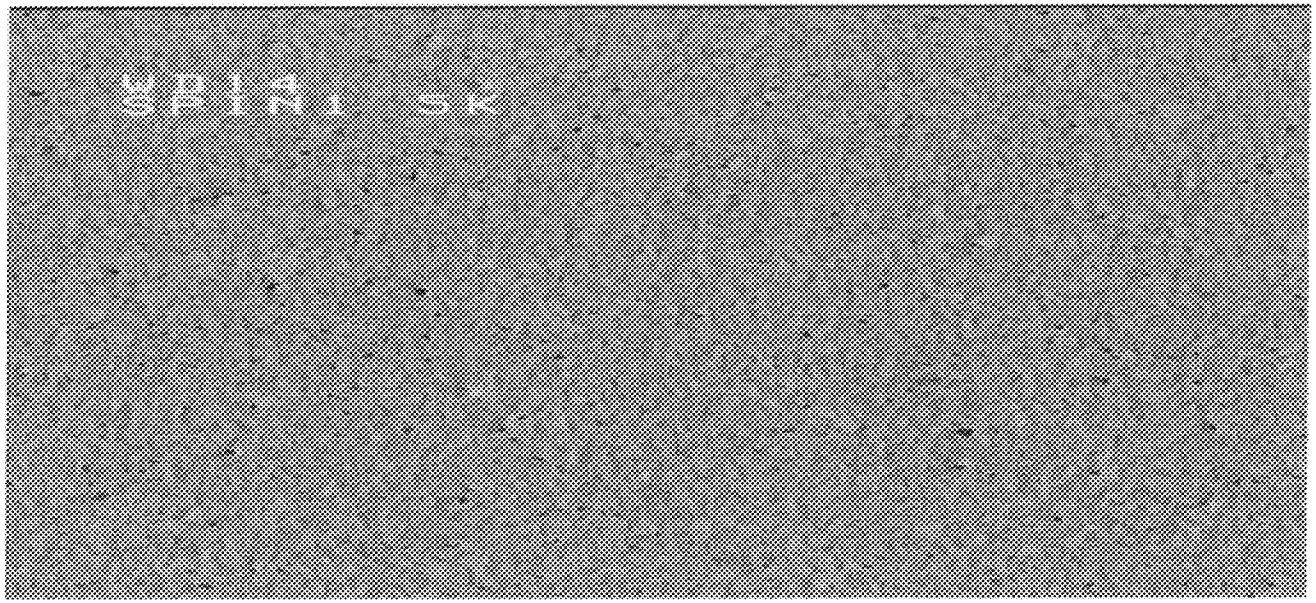
FIG. 3 is a scanning electron microscopy image of a coating layer prepared from a 0.7 M $(BiLa)_4Ti_3O_{12}$ solution by spin-coating.
Figure 4:
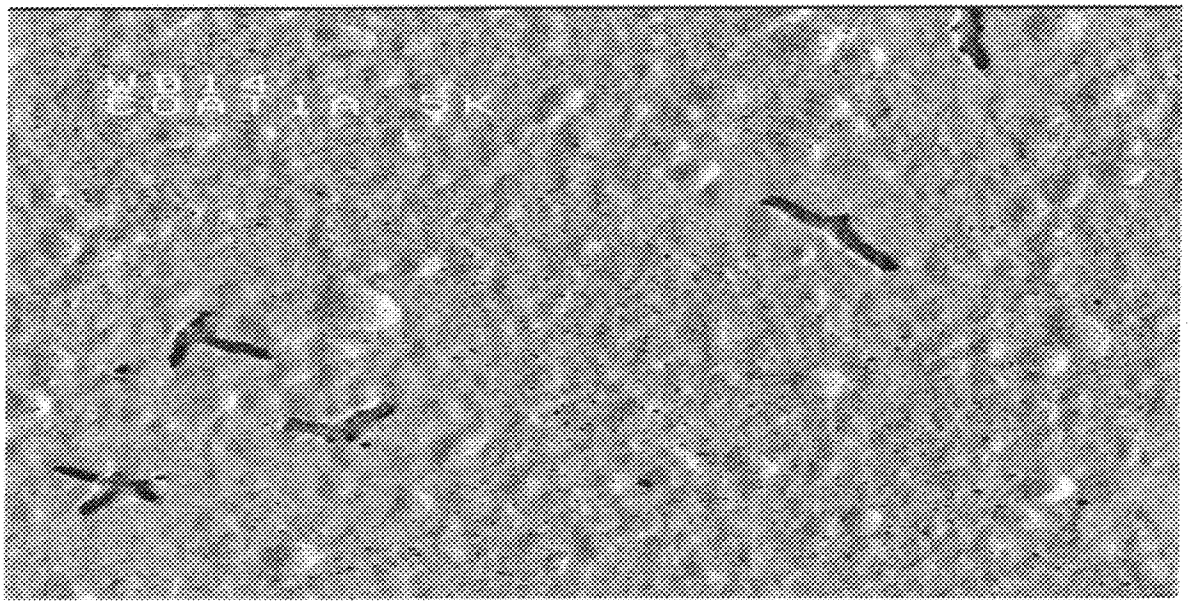
FIG. 4 is a scanning electron microscopy image of a coating layer prepared from a 0.7 M $(BiLa)_4Ti_3O_{12}$ solution by dip-coating.
Figure 5:
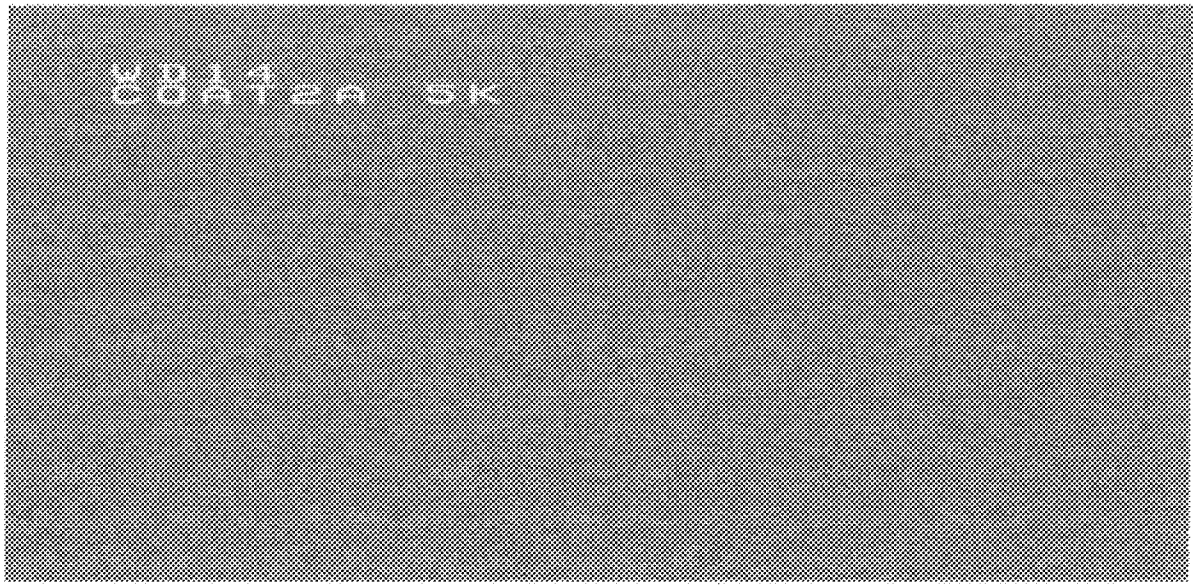
FIG. 5 is a scanning electron microscopy image of a coating layer prepared from a 0.7 M $(BiLa)_4Ti_3O_{12}$ solution according to the method depicted in FIG. 2.

The results of both measurements are summarized in Table 1, containing the fitted thickness for the three conditions based on spectroscopic ellipsometry and RBS, as well as the fitted atomic compositions based on RBS results. Finally, the surfaces of the various samples were inspected by Scanning Electron Microscopy. The results (for a 5000 times magnification) are represented in FIGS. 3, 4, and 5.

TABLE 1

| | Thickness | | Composition | | | |
|---|---|---|---|---|---|---|
| Method | Spectroscopic ellipsometry Thickness (nm) | RBS Thickness (nm) | RBS Atom % Bi | RBS Atom % Ti | RBS Atom % La | RBS Atom % O |
| Spin-coat | 61 +/− 0.002 | 60 | 14.5 | 16.1 | 4.8 | 64.5 |
| Dip-coat | 157.3 +/− 0.072 | 300 | 15.0 | 15.0 | 3.7 | 66.4 |
| This invention | 5.8 +/− 0.01 | 6 | 15.0 | 15.0 | 3.7 | 66.4 |

It should be understood that the illustrated embodiments are exemplary only and should not be taken as limiting the scope of the present invention. The claims should not be read as limited to the described order or element unless stated to that effect. Therefore, all embodiments that come within the scope and spirit of the following claims and equivalents thereto are claimed as the invention.

The invention claimed is:

1. A method for depositing a coating layer on at least part of a surface of a substrate comprising the steps of:

applying a coating substance to the at least part of the surface of the substrate to form a deposited coating layer, such that the deposited coating layer, the coating substance, and a gas phase intersect at a three-phase region;

subjecting the substrate to a relative movement with respect to a source of the coating substance, and at least part of the time while subjecting the substrate to the movement, controlling the thickness of the deposited coating layer by generating a surface tension gradient between (i) a first point of the coating substance at the three-phase region and (ii) a second point of the coating substance by delivering isopropyl alcohol to the coating substance at the three-phase region.

2. The method of claim 1, wherein the step for generating a surface tension gradient in the coating substance is performed by an external device.

3. The method of claim 1, wherein the isopropyl alcohol is in the form of a liquid, a solid, a vapor, a mist, or a gas.

4. The method of claim 1, wherein the isopropyl alcohol creates a local lowering of the surface tension and decreases the thickness of the coating layer.

5. The method of claim 1, wherein the isopropyl alcohol creates a local raising of the surface tension and increases the thickness of the coating layer.

6. The method of claim 1, wherein the coating layer is a continuous layer.

7. The method of claim 1, wherein the coating layer is a non-continuous layer.

8. The method of claim 1, wherein the coating substance is selected from the group consisting of a molten material, a sol gel solution, and a film precursor brought into a liquid state.

9. The method of claim 1, wherein the movement is selected from the group consisting of rotational, linear, and a combination of both rotational and linear.

10. The method of claim 1, wherein the surface of the substrate has a position selected from the group consisting of horizontal, vertical, and oblique.

11. The method of claim 1, wherein the method for depositing a coating layer is used in integrated circuit fabrication.

12. A method comprising:

applying a coating substance from a source to a substrate in contact with a gas phase to form a deposited coating layer, such that the deposited coating layer, the coating substance, and the gas phase intersect at a three-phase region;

while applying the coating substance, subjecting the substrate and the source to relative movement; and while applying the coating substance and subjecting the substrate and the source to relative movement, controlling the thickness of the deposited coating layer by generating a surface tension gradient in the coating substance by delivering isopropyl alcohol to the coating substance at the three-phase region.

13. The method of claim 12, wherein the isopropyl alcohol is in the form of a liquid, a solid, a vapor, a mist, or a gas.

* * * * *